United States Patent [19]

Arona-Delonghi

[11] Patent Number: 4,919,309

[45] Date of Patent: Apr. 24, 1990

[54] CAP FOR COLLAPSIBLE BOTTLES AND THE LIKE

[75] Inventor: Adriano G. Arona-Delonghi, Monterrey, Mexico

[73] Assignee: Fabricacion De Maquinas, S.A., Monterrey, Mexico

[21] Appl. No.: 311,471

[22] Filed: Feb. 15, 1989

[30] Foreign Application Priority Data

Feb. 15, 1988 [MX] Mexico ..... 10412

[51] Int. Cl.[5] ..... B65D 47/00

[52] U.S. Cl. ..... 222/153; 222/548; 222/553

[58] Field of Search ..... 222/519, 520, 548, 549, 222/553, 153

[56] References Cited

U.S. PATENT DOCUMENTS

| | | | |
|---|---|---|---|
| 3,317,093 | 5/1967 | Moran | 222/519 |
| 3,471,066 | 10/1969 | Micallef | 222/519 |
| 3,776,433 | 12/1973 | Detreitas | 222/519 |
| 4,480,769 | 11/1984 | Tellini | 222/519 |
| 4,544,063 | 10/1985 | Neward | 222/519 |
| 4,690,304 | 9/1987 | Morel | 222/520 |
| 4,773,103 | 9/1988 | Dahlheimer | 222/548 |
| 4,779,764 | 10/1988 | Debetencourt | 222/153 |

FOREIGN PATENT DOCUMENTS

| | | | |
|---|---|---|---|
| 613958 | 12/1960 | Italy | 222/553 |

*Primary Examiner*—H. Grant Skaggs
*Assistant Examiner*—Steve Reiss
*Attorney, Agent, or Firm*—Abelman Frayne Rezac & Schwab

[57] ABSTRACT

The present invention relates to an integral supply cap for dispensing liquid, semi-liquid or viscous products in which a tamperproof detachable section is provided, such that when the tamperproof section is detached, a dispensing orifice is formed.

8 Claims, 3 Drawing Sheets

CAP FOR COLLAPSIBLE BOTTLES AND THE LIKE

FIELD OF THE INVENTION

The present invention relates to a cap for collapsible bottles and like containers that are manufactured to store products in liquid, semi-liquid or viscous form.

BACKGROUND OF THE INVENTION

The user of liquid, semi-liquid or relatively viscous liquids, such as shampoos, creams, as well as foods (such as, purees, sauces, etc.) has always lacked a product that can be supplied in a regulated manner.

However, it is evident that, in practice, the user generally obtains a non-regulated product flow, which much of the time is in an amount that the user does not want.

The containers or bottles which contain these products are provided with threaded caps or stoppers having a pivotal section. However, a disadvantage of this type of cap is that when the user needs to remove the cap from the container, it is often found that it has been affixed too tightly around the neck of the container, which makes its removal very difficult.

An additional disadvantage of the prior art cap is that when the user sought to obtain a prescribed or definite quantity of product from the container, the user generally obtained an unwanted quantity.

Another disadvantage of these types of caps is that since they are usually manufactured with a removable piece, it is necessary to remove it from the container in order to extract its contents. This action may sometimes create a problem when the user replaces the removable piece again, since the piece may not be properly seated or threaded on the neck of the container. This creates a risk of losing the cap and, consequently, exposing the contents of the container to dirt, dampness, etc.

A further disadvantage of these caps is that the majority of them are manufactured in four or five pieces and, therefore, it is necessary to have individual moldings, machines and operators for each component, thereby increasing the manufacturing costs.

Based on the above, it was concluded that, in order to avoid the need to use machines and operators for each component part, as was required for the prior art caps, it would be necessary to create a combination of components which could be coupled together during a purely mechanical assembly operation, and once assembled, they would remain firmly interlocked and fastened together.

Furthermore, it was found that in order to reduce the number of components, it was necessary to re-design and simplify the components so that they could be integrally manufactured by a single machine, in order to allow for mechanical assembly, thereby reducing the number of stages and machines in the assembly operation.

In accordance with the above, the present invention relates to a cap for collapsible bottles and the like, which cap reduces the number of components to only two, by providing a design which can be molded on a single injection-molding machine.

Additionally, with the cap of the present invention, it is unnecessary to remove the cap from the bottle in order to extract the container's contents, since, simply by turning one of its components, the desired quantity of product can be removed from the container. The cap includes a detachable ring which is broken when first used, which guarantees that the product reaches the consumer having the same quality as when the bottles were filled, thus preventing the products from being tampered with during handling between the manufacturer and the consumer. Similarly, when the consumer wishes to close the container, he need only turn the cap with an opposite movement in order to return it to its original position.

Similarly, with the cap design of the present invention, the user can regulate the desired quantity of the product.

SUMMARY OF THE INVENTION

It is an object of the present invention to provide an integral cap for collapsible bottles and the like, which is manufactured in two pieces, with its components being mechanically attached with fewer manufacturing stages and less equipment.

Another object of the present invention is to provide an integral cap for collapsible bottles and the like which prevent the removal of the cap from the bottles by providing a cap with an integral pouring orifice which is opened by first rotating the cap. The permits the bottled product to exit the bottle, and if it is moved in the opposite direction, is seals the bottle.

Still another object of the invention is to provide an integral cap for collapsible bottles and the like, which contain liquid, semi-liquid or viscous products, through which a regulated quantity of product may be obtained.

BRIEF DESCRIPTION OF THE DRAWINGS

The invention will now be described with reference to the accompanying drawings, which illustrate a preferred embodiment of the invention, and in which.

DETAILED DESCRIPTION OF THE INVENTION

Figure 1:
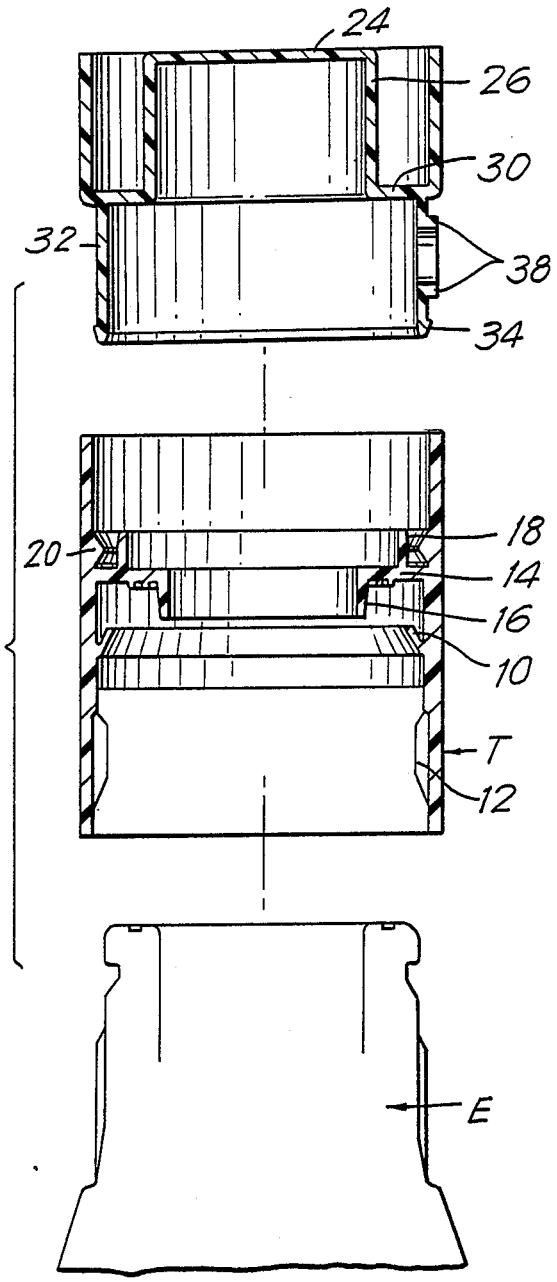
FIG. 1 is an exploded view, in longitudinal form, of the cap of the present invention showing its components.
Figure 2:
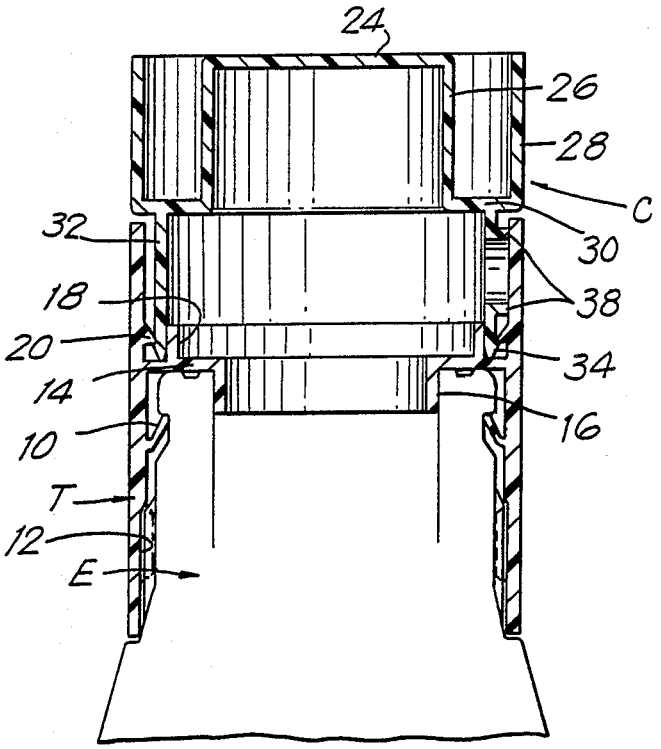
FIG. 2, shows the assembled cap in cross-section.

Referring now to FIGS. 1 and 2 of the drawings, the cap for bottles and the like includes, in combination, a retention member body T, of plastic material, having a tubular form. The retention member body T has on its lower part, a plurality of vertically disposed locking or fastening ribs 10, which are relatively flexible and which lock against the neck or crown of the bottle in order to prevent its slipping upwardly, and a plurality of vertical internal holding or locking legs 12, which can be attached to the edge of the neck of a bottle E, in order to prevent it from turning around the bottle.

The body T includes in its middle section, an annular seating wall 14 which is seated on the mouth of the bottle E; a first retention wall 16, perpendicular to said seating wall 14, which is disposed internally of the neck of the bottle; a second retention wall 18, disposed perpendicularly in the upper part of the annular wall 14; and, a circular locking edge 20 which on its internal periphery coincides with the second retention wall 18. The wall 18 and locking edge 20 maintain the position of the cover C, as will be described hereinafter.

Lastly, the upper part of the retention member body T comprises a detachable annular section 22 disposed about the periphery of the number body T, which is broken when the bottle is opened, guaranteeing the tamperproof seal of the cap. When the detachable section 22 is broken, an orifice is opened to permit the exit of the contents of the bottle.

A second element of the cap comprises a cover C, also of plastic material, which includes an upper or top wall 24; an internal tubular wall 26 attached to the top wall 24; a second external tubular wall 28, parallel to the internal wall 26; and an annular joining wall 30, located at the lower end of said walls 26 and 28. A third retention wall 32 is attached to the lower part of the annular joining wall 30, which is attached to the internal part of the retention member body T, as will be described hereinafter. Said third retention wall 32 having, at its lower end and directed outwardly thereof, a second locking member 34.

Figure 3:
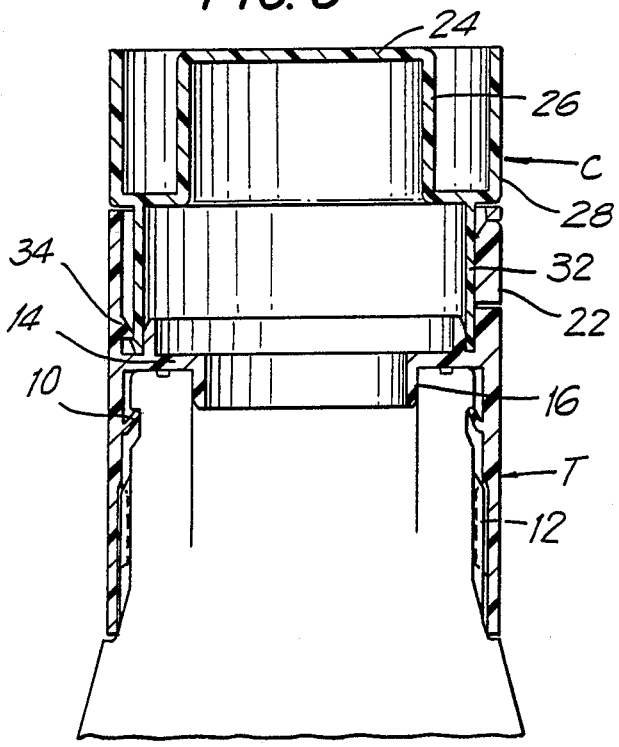
FIG. 3, is another view similar to the view illustrated in FIG. 2, showing the cap in the open position.
Figure 4:
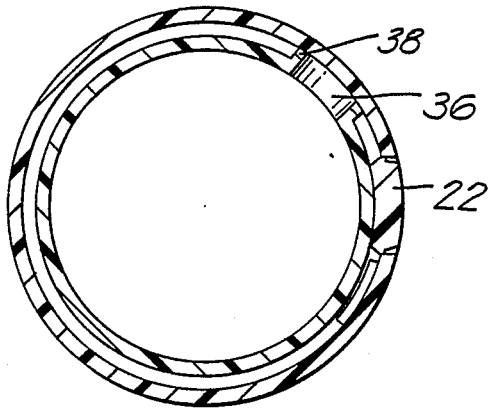
FIG. 4, is a plan view, showing the cap in the closed position.

With reference to the third retention wall 32, shown in FIGS. 3 and 4, the tubular wall 32 comprise an exit orifice 36 having small cylindrical wall 38, which breaks by contacting the detachable section 22 of the retention member body T when the cover C is rotated. In this manner, the exit orifice 36 will coincide with the orifice of the retention member body T, which is formed when the detachable section 22 is broken.

As may be seen in FIG. 4, the cover C shows only one exit orifice 36. However, the cover C and the retention member body T may include an additional orifice to permit the entry of air into the bottle. This additional orifice will avoid the vacuum effect in bottles which are not collapsible.

ASSEMBLY OF COMPONENTS

In the assembly of the cap of the present invention, as may be seen by reference to FIG. 1, the third retention wall 32 of the cover C is first inserted into the upper part of retention member body T. In this manner, both components are coupled by inserting the wall 32 between the locking edge 20 and the second retention wall 18 of the body T. The annular edge of second locking member 34 of the third retention wall 32 prevent the removal of the cover C from the body T.

Once the coupling of the components of the present invention has been carried out, the integral cap is assembled on the neck of the bottle E by inserting the lower end of the body T about the neck of the bottle E, in such a manner that the locking ribs 10 are bend slightly away from the body T, and remain locked in the neck of the bottle E. The vertical holding legs 12 maintain the body T and prevent it from turning about the neck of the bottle E.

When it is desired to use the cap to extract the contents of the bottle E, the cover C can be rotated within the retention body T. When the cap is rotated as may be seen in FIG. 4, the cylindrical wall 38 breaks the detachable section 22 form the body T causing the orifice 36 of the cover C and the orifice formed in the retention body T to coincide, thus permitting the extraction of the product container in bottle E. Thereafter, once the user has obtained the desired quantity of product, the cover C is turned in the opposite direction and the exit orifice 36 is covered and closed by the internal wall of the body T.

It will be understood by those skilled in the art that the embodiment of FIGS. 1 to 4 is a preferred embodiment of the invention and that various modifications may be made without departing from the scope of the appended claims.

I claim:

1. A cap for collapsible bottles and the like comprising:

(a) a retention member body for coupling hermetically to the mouth of the bottle, (i) said retention member having at one end thereof a plurality of relatively flexible vertical fastening ribs which lock against the edge of the bottle's neck to prevent the cap from sliding upwardly and a plurality of vertical locking legs which hold the cap against the edge of the bottles's neck to prevent the cap from turning about the bottle;

(ii) said retention member having at its other end a detachable annular section disposed about its periphery to form at least one exit orifice when it is detached, (iii) an annular wall connected to the internal part of the retention member body which serves as a seat on top of the mouth of the bottle, (iv) a first retention wall attached to the internal part of the mouth of the bottle and disposed perpendicularly to said annular seating wall, (v) a second retention wall disposed above said annular seating wall and extending perpendicularly and in a direction opposite to said first retention wall, and (vi) said retention member body comprising a first locking means:

(b) a cover for insertion into said retention member, said cover including:

(i) a top wall for covering the exit orifice of the bottle, (ii) at least one tubular wall attached to the top wall and disposed perpendicularly thereto, (iii) an annular joining wall attached to the lower end of said tubular wall; and (iv) a third retention wall located at the lower part of said annular joining wall, said third retention wall including second locking means which couple with the first locking means of the retention member body to prevent the removal of the cover from the retention member body, and having at least one exit orifice whereby when the cover is rotated in one direction the exit orifices of the retention member body and the third retention wall coincide to permit the passage of the bottle's contents and when the cover is rotated in the opposite direction the bottle is closed

2. The cap according to claim 1, wherein the third retention wall comprises a cylindrical wall about the exit orifice which causes said detachable section to break when the cover is rotated.

3. The cap according to claim 1, wherein the first locking means is an edge on the internal periphery of the retention member body.

4. The cap according to claim 1, wherein the second locking means is an edge at the external periphery of the third retention wall.

5. The cap according to claim 1, wherein the third retention wall is inserted into the upper part of the retention member body.

6. A cap for collapsible bottles and the like comprising:

(a) a retention member body for coupling hermetically to the mouth of the bottle, (i) said retention member having at one end thereof a plurality of relatively flexible vertical fastening ribs which lock against the edge of the bottle's neck to prevent the cap from sliding upwardly and a plurality of vertical locking legs which hold the cap against the edge of the bottle's neck to prevent the cap from turning about the bottle;

(ii) said retention member having at its other end a detachable annular section disposed about its periphery to form at least one exit orifice when it is detached, (iii) an annular wall connected to the internal part of the retention member body which serves as a seat on top of the mouth of the bottle, (iv) a first retention wall attached to the internal part of the mouth of the bottle and disposed perpendicularly to said annular seating wall, (v) a second retention wall disposed above said annular seating wall and extending perpendicularly and in a direction opposite to said first retention wall, and (vi) said retention member body comprising a first locking means;

(b) a cover for insertion into said retention member, said cover including:

(i) a top wall for covering the exit orifice of the bottle, (ii) at least one tubular wall attached to the top wall and disposed perpendicularly thereto, (iii) the said tubular wall including second locking means which couple with the first locking means of the retention member body to prevent the removal of the cover from the retention member body, and having at least one exit orifice whereby when the cover is rotated in one direction the exit orifices of the retention member body and the tubular wall coincide to permit the passage of the bottle's contents and when the cover is rotated in the opposite direction the bottle is closed

7. The cap according to claim 6, wherein the tubular wall comprises a cylindrical wall about the exit orifice which causes said detachable section to break when the cover is rotated.

8. The cap according to claim 6, wherein the second locking means is an edge at the external periphery of the at least one tubular wall.

* * * * *